US006209723B1

(12) United States Patent
Fields

(10) Patent No.: US 6,209,723 B1
(45) Date of Patent: Apr. 3, 2001

(54) TOOL WRAPS

(76) Inventor: Darren Fields, 967 Cherry St., San Carlos, CA (US) 94070

( * ) Notice: Subject to any disclaimer, the term of this patent is extended or adjusted under 35 U.S.C. 154(b) by 0 days.

(21) Appl. No.: 09/490,618

(22) Filed: Jan. 25, 2000

(51) Int. Cl.[7] ..... B65D 85/28
(52) U.S. Cl. ..... 206/373; 383/39; 190/109
(58) Field of Search ..... 206/736, 372, 206/373, 216, 349, 376, 377; 383/38, 39, 40; 190/109, 102

(56) References Cited

U.S. PATENT DOCUMENTS

| | | | | |
|---|---|---|---|---|
| 4,773,535 | | 9/1988 | Cook . | |
| 4,901,464 | * | 2/1990 | Banoun | 206/373 |
| 5,002,401 | | 3/1991 | Blackman . | |
| 5,139,143 | * | 8/1992 | Pond | 206/373 |
| 5,423,404 | | 6/1995 | Shaw . | |
| 5,427,239 | | 6/1995 | Hunt . | |
| 5,653,337 | | 8/1997 | Cirigliano . | |
| 5,988,383 | * | 11/1999 | Armstrong | 206/373 |
| 6,070,729 | * | 6/2000 | Barnes | 206/373 |
| 6,116,419 | * | 9/2000 | Campagne et al. | 206/373 |

* cited by examiner

*Primary Examiner*—Paul T. Sewell
*Assistant Examiner*—Shian Luong
(74) *Attorney, Agent, or Firm*—Michael I Kroll

(57) ABSTRACT

The present invention 10 discloses a fabric wrap 28 within which variously shaped tools 30 are wrapped. The walls of the wrap 28 are hingedly connected 21. A padding material 16 is provided on the interior of the wrap 28 for protecting the tool 30. Pockets 12, 14 are also attached on the interior of the padding material 16 for holding either tools or accessories therefor. Multiple cloth members 18 are provided on the ends of the wrap 28 for being folded over the tool in order to protect the tool. Multiple flaps 20 are also provided for being folded over the wrap 28 and attached by means 22 to the back of the wrap 28. Straps 24 are also provided having means 22 for attachment whereby the wrap is secured. A carrying handle 26 is also provided. Embodiments are provided having different shapes for various tools and having variations to the flap 20 configuration. An embodiment comprising a case 46 is also shown that has a detachable side panel 48 and a built-in electric outlet 50 with an attached extension cord 62.

7 Claims, 17 Drawing Sheets

RECIPROCATING SAW

TOOL WRAPS

BACKGROUND OF THE INVENTION

1. Field of the Invention

The present invention relates generally to portable tool cases and, more specifically, to individualized wraps for tools wherein said wraps conform to the shape of the selected tool prior to wrapping. Said wraps have a durable outer cover made of a material such as canvas having a foam-like padding material bonded to the inside surface of the outer cover. Further there are pockets on the interior side of the wrap for storing tool accessories, and straps having hook and loop material on one end and mating hook and loop material located on the wrap providing means of securing the tool to the wrap and/or accessory items to the wrap prior to folding. In addition, after folding the tool within the wrap, there are provided a plurality of flaps and straps having hook and loop material for securing said tool and wrap in the closed position whereby said wrapped tool can be stored in other tool holding cases without damaging the wrapped tool and tool accessories. Also said wrap has a handle for carrying the wrapped tool.

Another embodiment is provided comprised of a carrying case having a plurality of pockets, straps having hook and loop material and an electrical outlet embedded within the structure of said case having a length of heavy duty electrical cord whereby the user can plug various electrical tool into the carrying case outlet which will reduce the number of extension cords and allow for more than one tool to be plugged in at the same time.

2. Description of the Prior Art

There are other portable tool cases designed to carry and/or protect selected tools. Typical of these is U.S. Pat. No. 4,773,535 issued to Cook on Sep. 27, 1988.

Another patent was issued to Blackman on Mar. 26, 1991 as U.S. Pat. No. 5,002,401. Yet another U.S. Pat. No. 5,139,143 was issued to Pond on Aug. 18, 1992 and still yet another was issued on Jun. 13, 1995 to Shaw as U.S. Pat. No. 5,423,404. Another patent was issued to Hunt on Jun. 27, 1995 as U.S. Pat. No. 5,427,239. Yet another U.S. Pat. No. 5,653,337 was issued to Cirigliano on Aug. 5, 1997.

U.S. Pat. No. 4,773,535

Inventor: Ralph E. Cook

Issued: Sep. 27, 1988

A portable tool case has at least two canvas panels attached together. Each panel includes at least one, and preferably a plurality of, tool holding pockets, each pocket for holding a single tool. In one embodiment, two panels are hingedly attached together along a mating edge such that the case can be draped over a sawhorse, protective railing, etc., a panel hanging on each side of the sawhorse. The tool holding pockets are located on the exterior surfaces of the panels, as the case rests on the sawhorse, and support tools of a particular trade in fully exposed and easily accessible manner. The two panels may be attached together and the case easily transported by hand by a handle located On the hinged attachment of the two panels.

A second embodiment resembles a portfolio or attache case. The two panels comprising the tool case have the plurality of tool holding pockets on the interior sides of the panels, such that the tools can be enclosed when the case is folded over and closed.

A third embodiment encloses a top horizontal panel and four vertical panels defining an open-bottom box-like device. This embodiment is adapted to fit down over, and be supported on top of a stepladder. Three or more of the vertical panels each include at least one tool holding pocket. This embodiment, fully loaded with tools, may be easily carried about by the handle on the top handle.

U.S. Pat. No. 5,002,401

Inventor: Marianne Blackman

Issued: Mar. 26, 1991

An article holder and carrier includes a box-like container having fabric walls reinforced with soft, shock absorbing material and adapted to disconnect along an edge between two walls and around three edges of a base panel to unfold to a flat position for access to articles held within the holder and carrier. Access is also provided by a drawstring closure at one end of the article holder and carrier and is further provided by unfolding the base panel at another end. The article holder and carrier includes pockets or other compartments sewn to an inner surface of the fabric walls and base panel with the pockets or compartments being adapted to hold the articles against the fabric walls providing rigidity and support therefor.

U.S. Pat. No. 5,139,143

Inventor: William M. Pond

Issued: Aug. 18, 1992

A padded tool-carrying portfolio which comprises at least two relatively flat, planar leaves joined together by at least one hinge arrangement, wherein at least one of the at least two leaves comprises a tool-carrying surface which is adapted to carry a plurality of hand tools and other items thereon and to present them for easy grasping by the workman. and wherein at least one of the at least two leaves comprises a firm yet resilient padded mat for the workman to kneel on and which is relatively soft yet simultaneously provides adequate support for the workman's weight. During transport, the portfolio's at least two flat, planar leaves are closed together so that the at least two leaves face and engage one another. On site, the portfolio is opened up and laid down on the worksurface so as to present both the tool-carrying surface and the padded mat to the workman. As a result, the workman is able to effect repairs while comfortably kneeling on the clean soft surface of the portfolio's padded mat, with his most important hand tools positioned conveniently within reach.

U.S. Pat. No. 5,423,404

Inventor: John R. Shaw

Issued: Jun. 13, 1995

A triple section tool case includes a center cargo bay and two outer sections. One of the outer sections has built-in tool-receiving compartments and the other of the outer sections is a slim-line attachè case. The cargo bay is opened and closed by means of a dual zipper and hook and loop connector flap.

U.S. Pat. No. 5,427,239

Inventor: John F. Hunt

Issued: Jun. 27, 1995

A flexible tool pouch having a plurality of elongated pockets securely positioned adjacent to each other. Each pocket has an inside liner made of woven nylon, and an outside liner made of acrylic pile and an open end for receiving a tool. Extending from the open end of the connected pockets is a hood made of acrylic pile that can be partially folded over the tools. Also positioned on the tool pouch are eyelets, handle straps, and a securing strap.

U.S. Pat. No. 5,653,337

Inventor: Charles F. Cirigliano

Issued: Aug. 5, 1997

A reversible tote bag of foldable construction for containing workmen's tools having a reversible folding wall with a reversible closure adapted to be changeable into multiple positions for case of use and access, said reversible tote bag addapted for the storage, display, accessing and carrying of workmen tool having a unitary container panel that is closable to form a tote bag, openable to allow access thereto and reversible permitting the tote bag to be turned inside out, also a plurality of individual compartments adapted to contain workmen tools are provided and a transport device connected to the container panel for a workman to carry the bag in a plurality of modes, either by hand or on shoulders as with a knapsack. The reversible closure apparatus permits a workman to connect and disconnect the peripheral edge, so that the bag may move between at least five positions for ease of use and access.

While these portable tool cases designed to carry and/or protect selected tools may be suitable for the purposes for which they were designed, they would not be as suitable for the purposes of the present invention, as hereinafter described.

SUMMARY OF THE PRESENT INVENTION

The present invention discloses a fabric wrap within which variously shaped tools are wrapped. The walls of the wrap are hingedly connected. A padding material is provided on the interior of the wrap for protecting the tool. Pockets are also attached on the interior of the padding material for holding either tools or accessories therefor. Multiple cloth members are provided on the ends of the wrap for being folded over the tool in order to protect the tool. Multiple flaps are also provided for being folded over the wrap and attached by means to the back of the wrap. Straps are also provided having means for attachment whereby the wrap is secured. A carrying handle is also provided. Embodiments are provided having different shapes for various tools and having variations to the flap configuration. An embodiment comprising a case is also shown that has a detachable side panel and a built-in electric outlet with an attached extension cord.

A primary object of the present invention is to provide a tool wrap for the protection of selective tools.

Another object of the present invention is to provide a tool wrap made of a durable soft material such as canvas.

Yet another object of the present invention is to provide a tool wrap made of a durable soft material such as canvas having an inside cushioning liner such as foam rubber.

Still yet another object of the present invention is to provide a tool wrap made of a durable soft material such as canvas having an inside cushioning liner such as foam rubber and having a plurality of flaps for sealing said tool inside said tool wrap.

Yet another object of the present invention is to provide a soft case-like tool bag having a removable side wall which can be used as a workspace having a plurality of straps providing means for securing various types of accessory tools.

Additional objects of the present invention will appear as the description proceeds.

The present invention overcomes the shortcomings of the prior art by providing individualized wraps for tools wherein said wraps conform to the shape of the selected tool prior to wrapping. Said wraps have a durable outer cover made of a material such as canvas having a foam-like padding material bonded to the inside surface of the outer cover. Further there are pockets on the interior side of the wrap for storing tool accessories, and straps having hook and loop material on one end and mating hook and loop material located on the wrap providing means of securing the tool to the wrap and/or accessory items to the wrap prior to folding. In addition, after folding the tool within the wrap, there are provided a plurality of flaps and straps having hook and loop material for securing said tool and wrap in the closed position whereby said wrapped tool can be stored in other tool holding cases without damaging the wrapped tool and tool accessories. Also said wrap has a handle for carrying the wrapped tool.

Another embodiment is provided comprised of a carrying case having a plurality of straps having hook and loop material and an electrical outlet embedded within the structure of said case having a length of heavy duty electrical cord whereby the user can plug various electrical tool into the carrying case outlet which will reduce the number of extension cords and allow for more than one tool to be plugged in at the same time.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the inventions and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
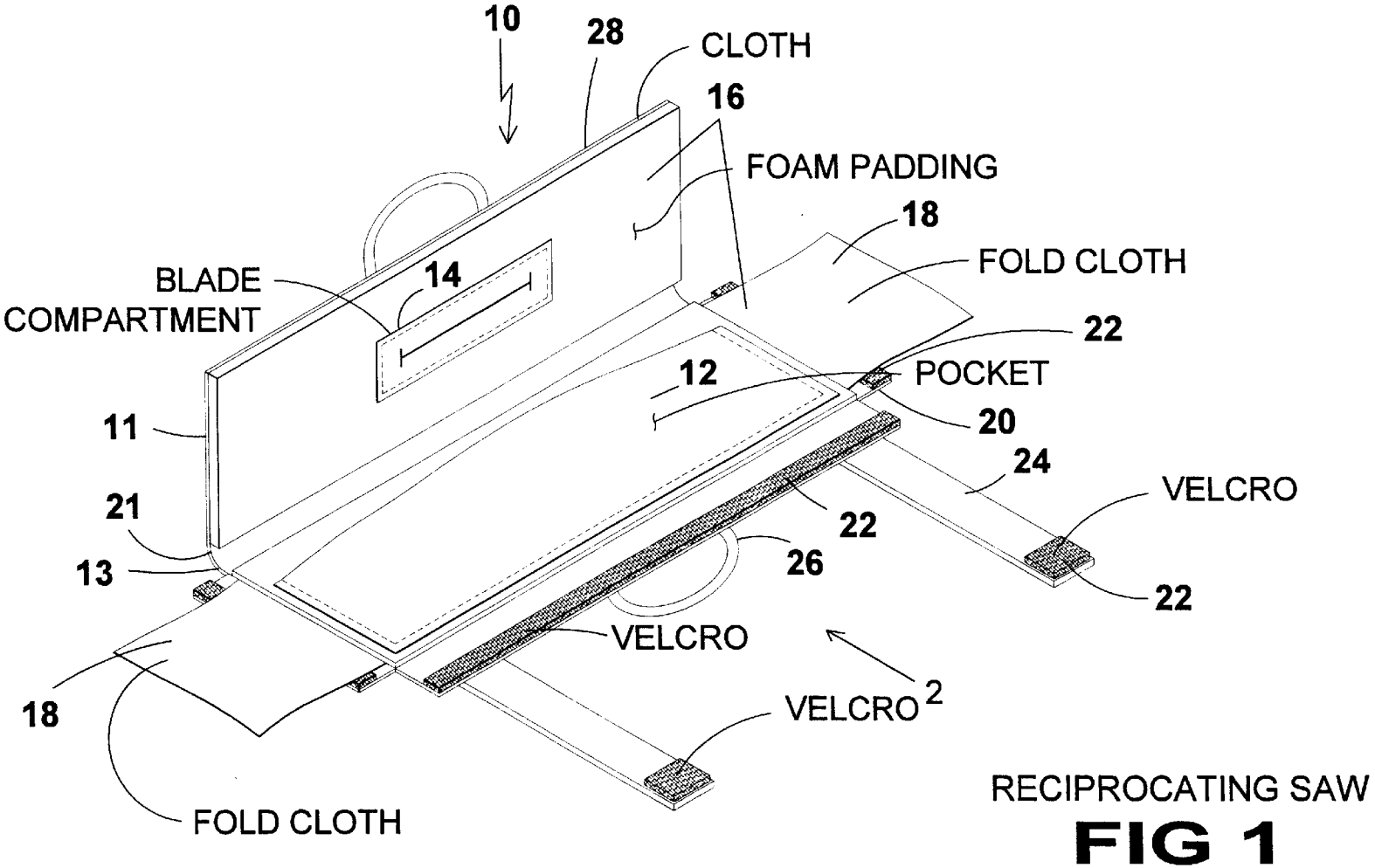
FIG. 1 is a perspective view of a typical wrap of the present invention which can be used to wrap a reciprocating saw. The wrap conforms to a basically linear tool, having a large pocket wherein said tool will be inserted. An additional pocket is provided for the storage of additional accessories such as blades. The interior of the wrap has a layer of foam padding providing protection to the saw. Additionally, located on each end is a flap, which is folded into the wrap after placement of the tool providing additional protection. Further there is provided flaps having hook and loop material which will engage mating hook and loop material located on the exterior hem of the opposing side which will seal the tool within the wrap as well as preventing dust and dirt from entering. There are also two long straps having hook and loop material on one end which will encircle the tool and engage mating hook and loop material on the back side of the strap. There is also a pair of handles, which will provide means for carrying said tool.

With regard to reference numerals used, the following numbering is used throughout the drawings.

10 present invention
11 first side wall
12 pocket
13 second side wall
14 pocket
16 foam padding
18 flap
18 flap
21 hinged connection
22 hook and loop material
24 long straps
26 handles
28 wrap
30 reciprocating saw
32 drill
34 hand saw
36 blade guard
38 teeth
40 outer member
42 inner member
44 groove
46 carrying case
48 side panel
50 electric outlet
52 means for attachment
54 straps
56 large strap
58 jig saw
60 cloth cover
62 extension cord
64 means for mounting
66 base

DESCRIPTION OF THE PREFERRED EMBODIMENT(S)

In order that the invention may be more fully understood, it will now be described, by way of example, with reference to the accompanying drawings in which FIGS. 1 through 20 illustrate the present invention being individually shaped tool wraps.

Turning to FIG. 1, shown therein is a perspective view of a typical wrap of the present invention 10 which will be used to wrap a reciprocating saw. The wrap 28 conforms to a basically linear tool, having a large pocket 12 wherein the tool will be inserted with the first side wall 11 and second side wall 13 being hingedly connected 21. An additional pocket 14 is provided for the storage of additional accessories such as blades. The interior of the outer wrap 28 has a layer of foam padding 16 providing protection to the saw. Additionally, located on each end is a flap 18 which is folded into the wrap 28 after placement of the tool providing additional protection. Further there is provided at least one flap 20 having hook and loop material 22 which will engage mating hook and loop material located on the exterior hem of the opposing side of wrap 28 which will seal the tool within the wrap 28 as well as preventing dust and dirt from entering. There are also two long straps 24 having hook and loop material 22 on one end which will encircle the tool and engage mating hook and loop material on the back side of the strap 24. There is also a pair of handles 26 which will provide means for carrying the present invention 10. Cloth is also shown as a possible construction material for wrap 28.

Figure 2:
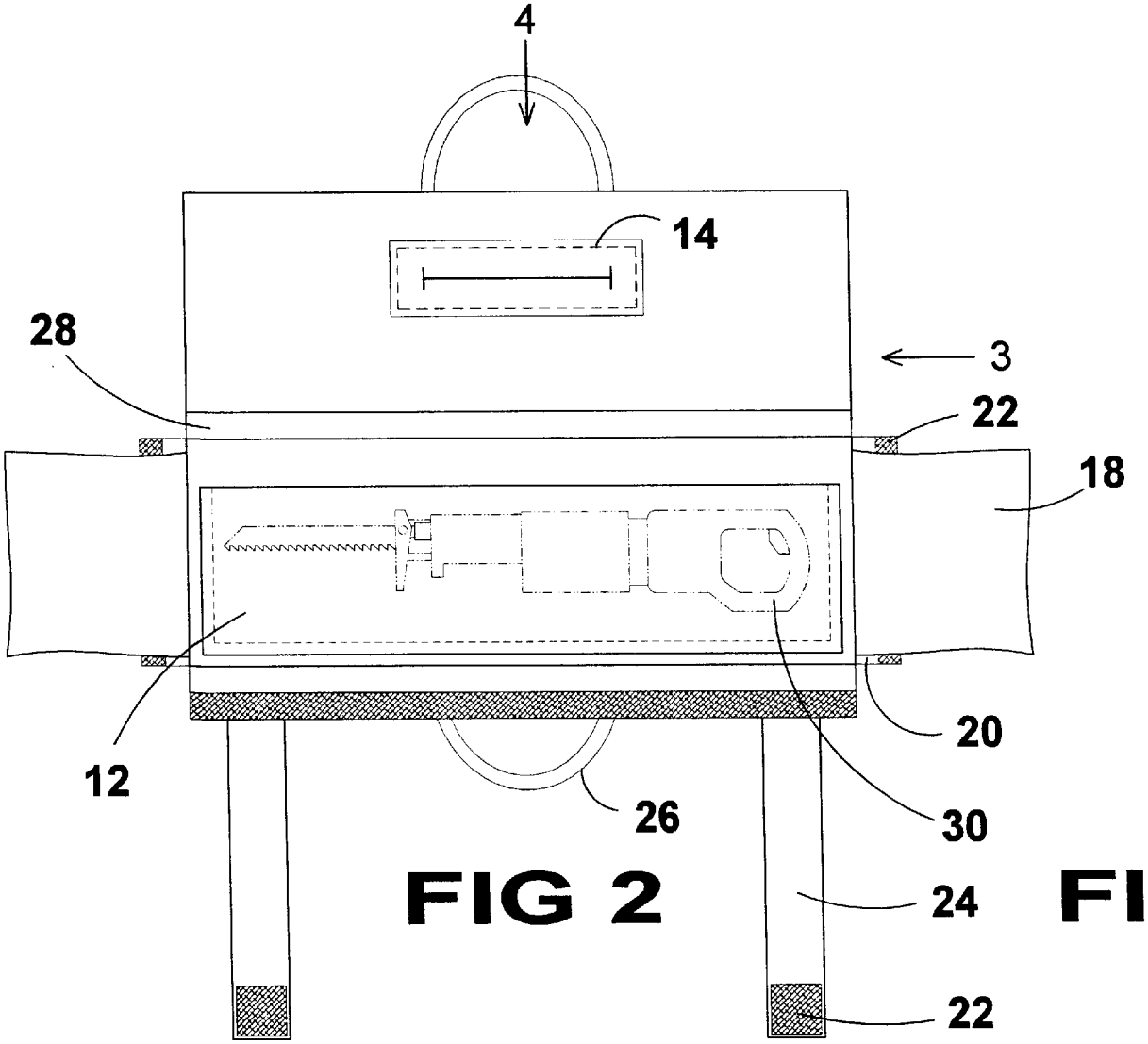
FIG. 2 is a plan view of the tool wrap as shown in FIG. 1. Shown is the tool wrap having a reciprocating saw, shown in outline, installed in the pocket of the tool wrap. Also shown is a plurality of flaps having hook and loop material which will engage mating hook and loop material located on the exterior hem of the opposing sides which will seal the tool within the wrap as well as preventing dust and dirt from entering. There are also two long straps having hook and loop material on one end which will encircle the tool and engage mating hook and loop material on the back side of the strap. There is also a pair of handles which will provide means for carrying said tool.

Turning to FIG. 2, shown therein is a plan view of the tool wrap 10 as shown in FIG. 1. Shown is the tool wrap having a reciprocating saw 30, shown in outline, installed in the pocket 12 of the tool wrap 28. Also shown is a plurality of flaps 18 and 20 having hook and loop material 22 thereon which will engage mating hook and loop material located on the exterior hem of the opposing sides which will seal the tool within the wrap 28 as well as preventing dust and dirt from entering. There are also two long straps 24 having hook and loop material 22 on one end which will encircle the tool and engage mating hook and loop material on the back side of the strap. There is also a pair of handles 26 which will provide means for carrying said tool.

Figure 3:
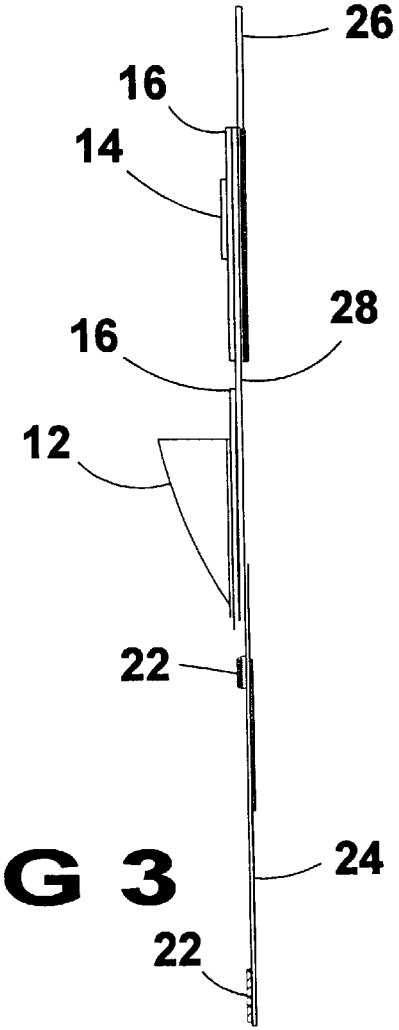
FIG. 3 is a side view of the tool wrap of the present invention, taken from FIG. 2 as indicated.

Turning to FIG. 3, shown therein is a side view of the tool wrap of the present invention, taken from FIG. 2 as indicated. Features previously disclosed are shown.

Figure 4:
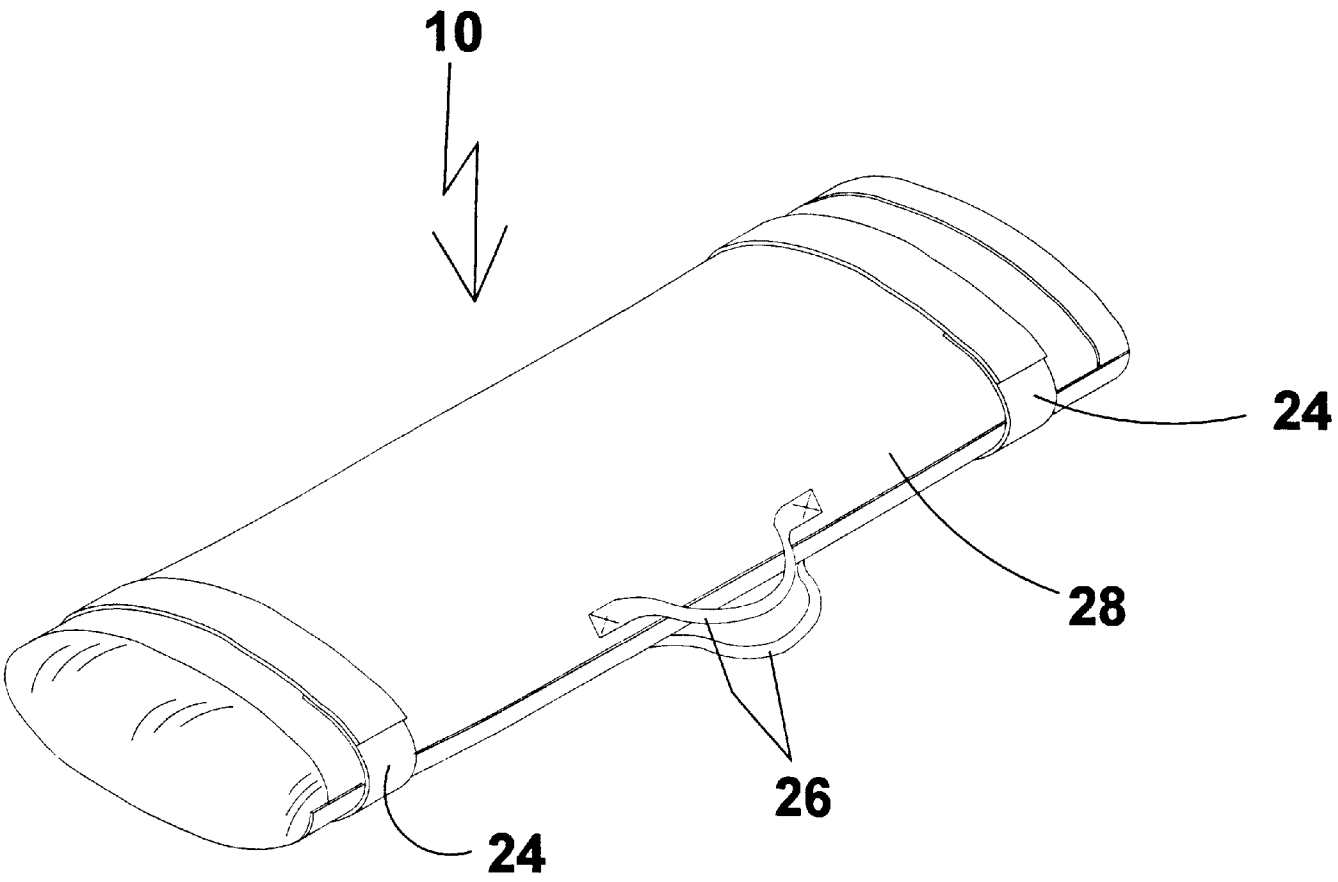
FIG. 4 is a perspective view of the wrapped tool as shown in FIG. 2. Shown is a tool wrap having a selected tool therein having means for sealing the contents of the tool wrap from dust, dirt, and abrasion from other tool. In addition the tool wrap has a handle providing means for carrying said tool.

Turning to FIG. 4, shown therein is a perspective view of the present invention 10 as shown FIG. 2. Shown is a tool wrap 28 having a selected tool therein having means for sealing the contents of the tool wrap from dust, dirt, and abrasion from other tool. In addition the tool wrap has a handle 26 providing means for carrying said tool.

Figure 5:
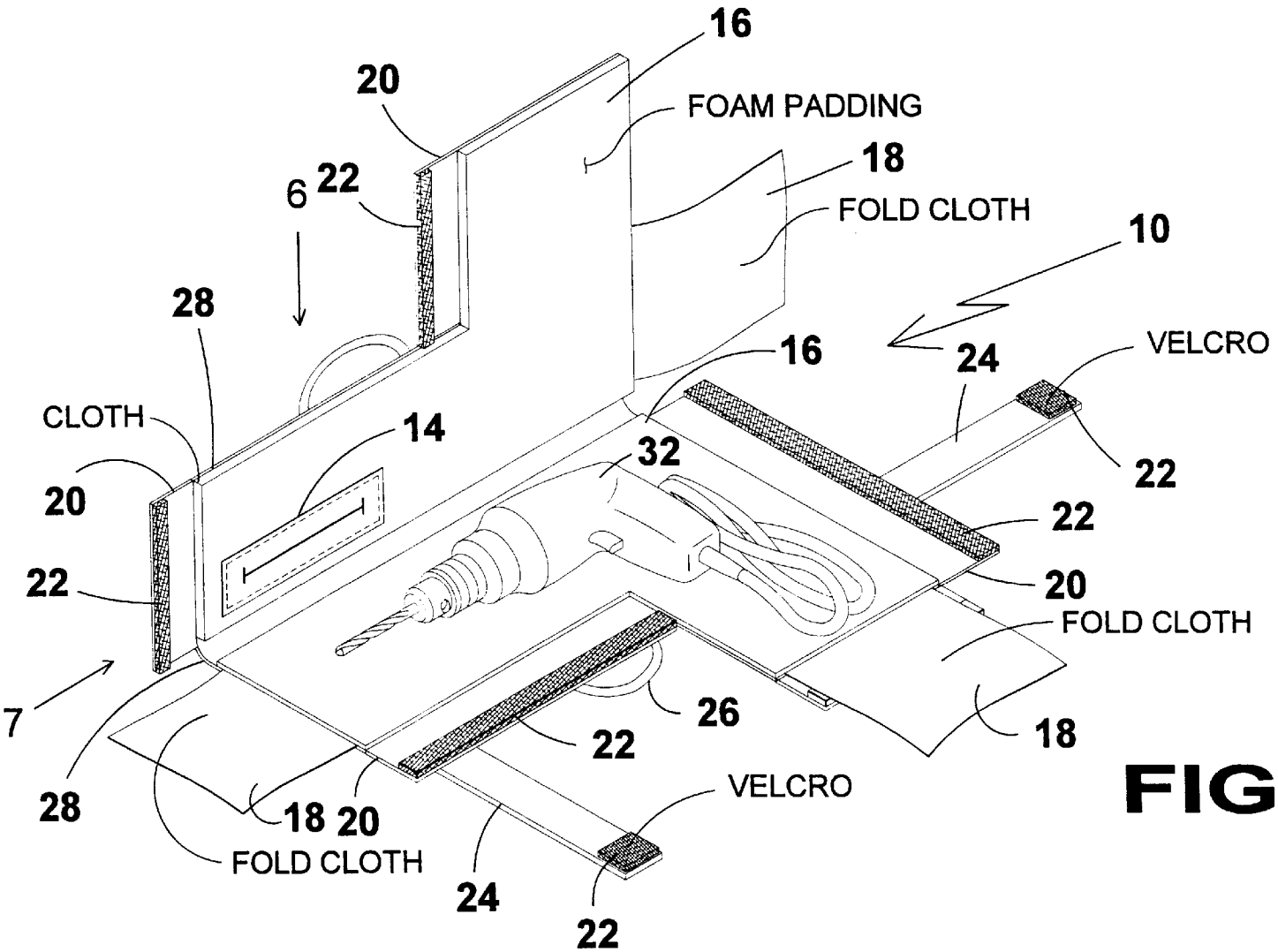
FIG. 5 is a perspective view of a different variation of the tool wrap of the present invention which can be used to wrap a drill or nail gun. The wrap conforms to a basically L-shape. A pocket is provided for the storage of additional accessories such as drill bits. The interior of the wrap has a layer of foam padding providing protection to the tool. Additionally, there are flaps which are folded into the wrap after placement of the tool providing additional protection. Further there is provided flaps having hook and loop material which will engage mating hook and loop material located on the exterior hem of the opposing side which will seal the tool within the wrap as well as preventing dust and dirt from entering. There are also two long straps having hook and loop material on one end which will encircle the tool and engage mating hook and loop material on the back side of the strap. There is also a pair of handles which will provide means for carrying said tool.

Turning to FIG. 5, shown therein is a perspective view of a different variation of the tool wrap of the present invention 10 which can be used to wrap a drill or nail gun 32. The wrap 28 conforms to a basically L-shape. A pocket 14 is provided for the storage of additional accessories such as drill bits. The interior of the wrap has a layer of foam padding 16 providing protection to the tool 32. Additionally, there are flaps 18 which are folded into the wrap after placement of the tool 32 providing additional protection. Further there is provided flaps 20 having hook and loop material 22 which will engage mating hook and loop material located on the exterior hem of the opposing side which will seal the tool 32 within the wrap as well as preventing dust and dirt from entering. There are also two long straps 24 having hook and loop material 22 on one end which will encircle the tool and engage mating hook and loop material on the back side of the strap 24. There is also a pair of handles 26 which will provide means for carrying the tool.

Figure 6:
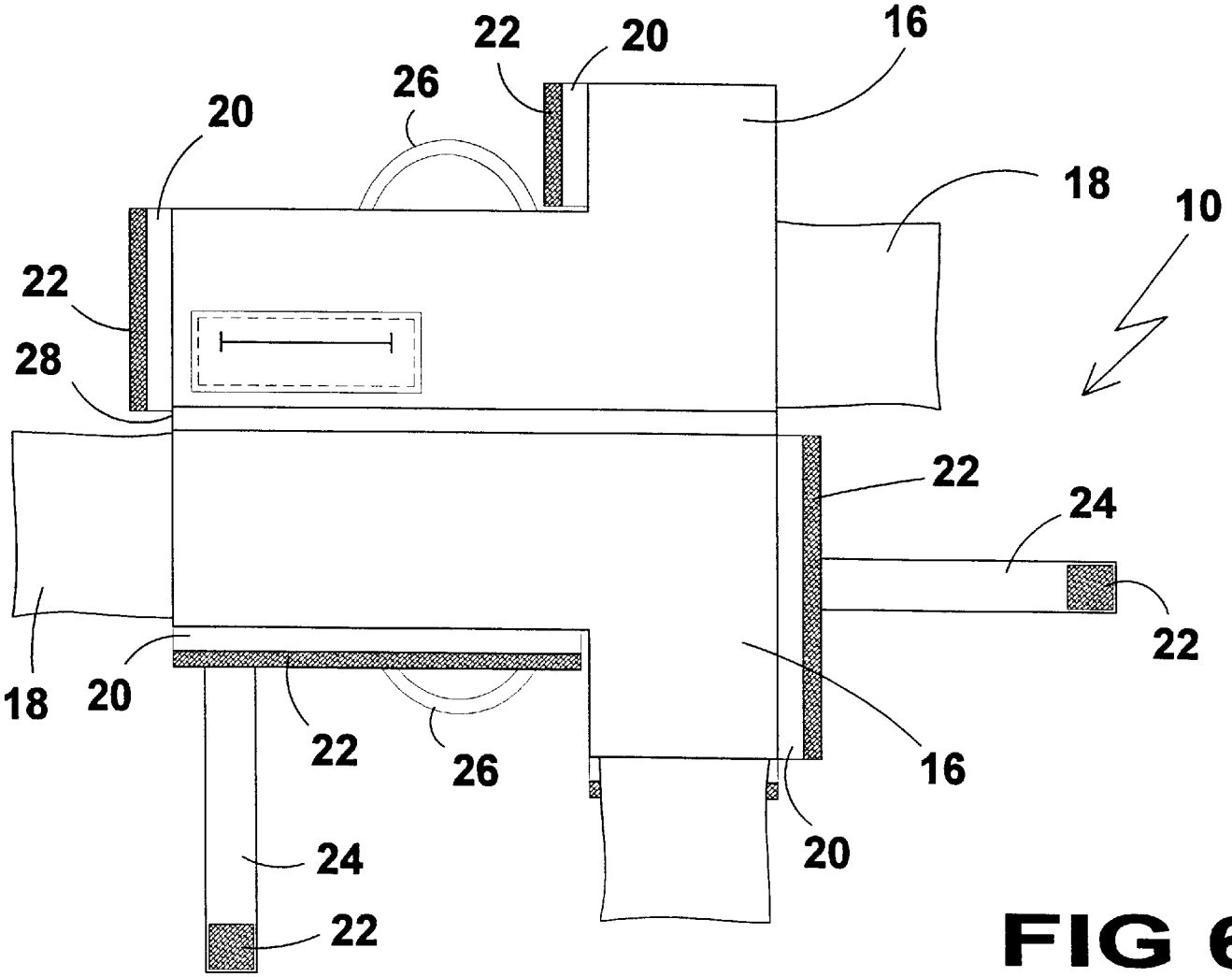
FIG. 6 is a plan view of the tool wrap as shown in FIG. 5. Shown is the tool wrap having flaps which fold over the tool after placement on the wrap. As well as, flaps having hook and loop material which will seal the tool within the wrap sealing the wrap from dust and dirt, and there is provided additional strap which will encompass the circumference of the wrap and straps having hook and loop material for sealing the wrap from dust and dirt. In addition there is provided two long straps having hook and loop material on one end which will encircle the tool and engage mating hook and loop material on the back side of the strap. There is also a pair of handles which will provide means for carrying said tool.

Turning to FIG. 6, shown therein is a plan view of the tool wrap as shown in FIG. 5. Shown is the tool wrap 28 having flaps 18 which fold over the tool after placement on the wrap. Also shown are flaps 20 having hook and loop material 22 which will seal the tool within the wrap sealing the wrap from dust and dirt, and there is provided two long straps 24 having hook and loop material 22 on one end which will encircle the tool and engage mating hook and loop material on the back side of the strap. There is also a pair of handles 26 which will provide means for carrying the tool.

Figure 7:
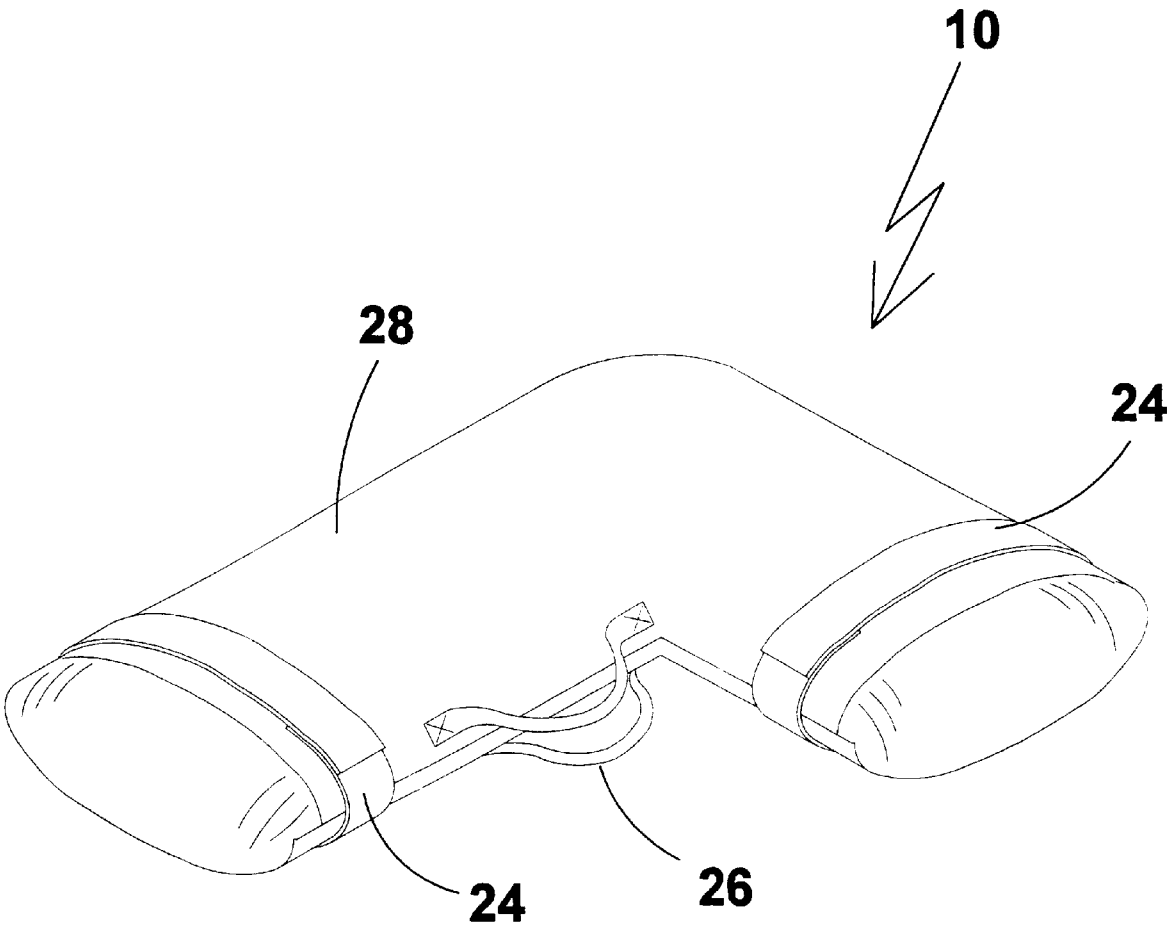
FIG. 7 is an illustrative perspective view of a wrapped tool, using the wrap illustrated in FIG. 5. Shown is a tool wrap having a selected tool therein having means for sealing the contents of the tool wrap from dust, dirt, and abrasion from other tool. In addition the tool wrap has a handle.

Turning to FIG. 7, shown therein is an illustrative perspective view of a wrapped tool, using the present invention 10 illustrated in FIG. 5. Shown is a tool wrap 28 having a selected tool therein having means 24 for sealing the contents of the tool wrap from dust, dirt, and abrasion from other tool. In addition the tool wrap has a handle 26.

Figure 8:
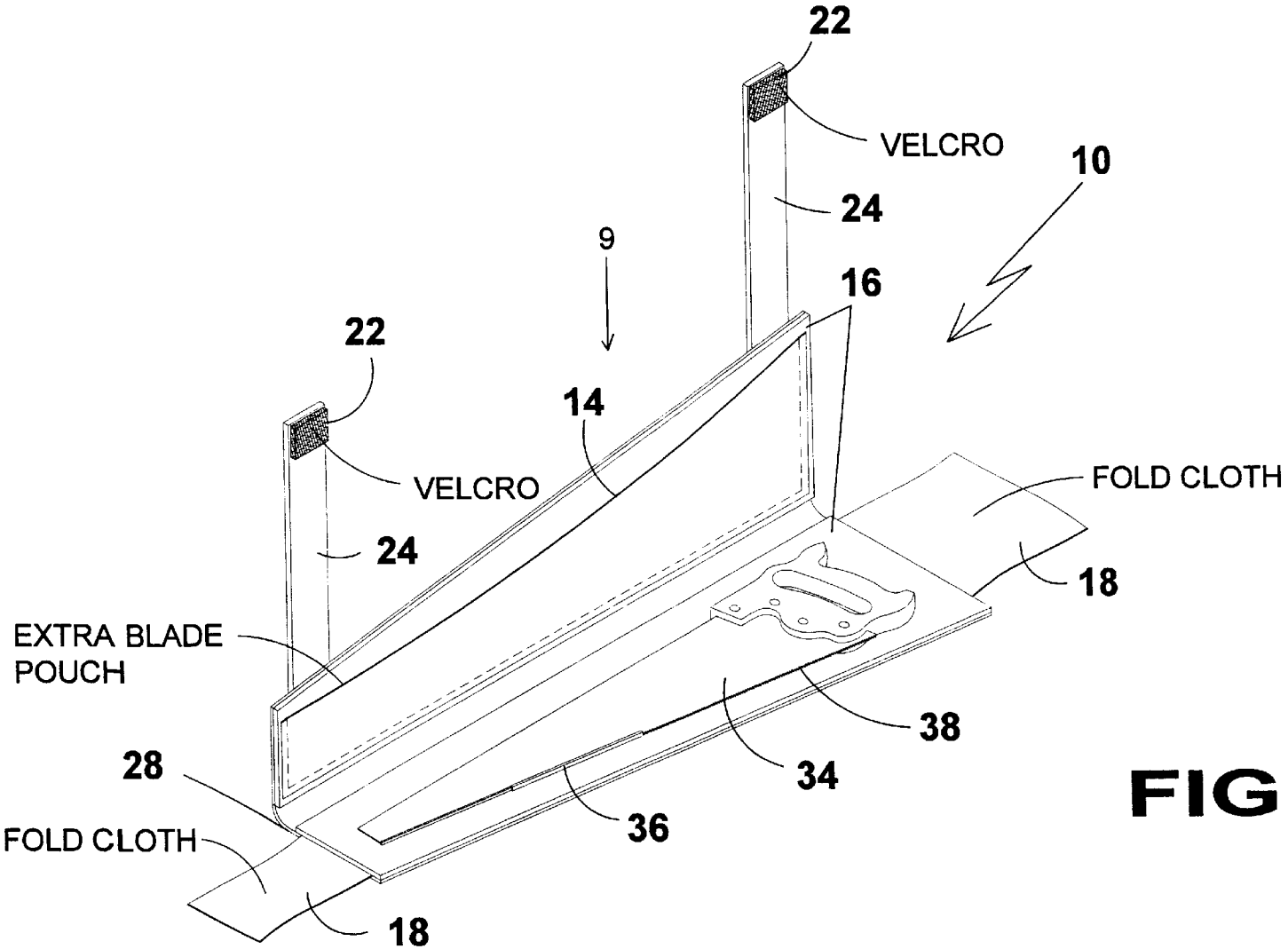
FIG. 8 is a perspective view of another type of tool wrap of the present invention which can be used to wrap handsaws. The wrap conforms to a basically tapered linear shape. A pocket is provided for the storage of additional accessories such as blades. The interior of the wrap has a layer of foam padding providing protection to the saw and a blade guard which will selectively protect the teeth of the blade will enclosed therein. Additionally, located on each end is a flap which is folded into the wrap after placement of the tool providing additional protection. There are two long straps having hook and loop material on one end which will encircle the tool and engage mating hook and loop material on the back side of the strap.

Turning to FIG. 8, shown therein is a perspective view of another type of tool wrap of the present invention 10 which can be used to wrap handsaws 34. The wrap 28 conforms to a basically tapered linear shape of conventional saw 34. A pocket 14 is provided for the storage of additional accessories such as blades. The interior of the wrap has a layer of foam padding 16 providing protection to the saw 34 and a blade guard 36 which will selectively protect the teeth 38 of the saw blade 34 which will be enclosed therein. Additionally, located on each end is a flap which is folded into the wrap after placement of the tool 34 providing additional protection. There are two long straps 24 having hook and loop material 22 on one end which will encircle the tool 34 and engage mating hook and loop material on the back side of the strap.

Figure 9:
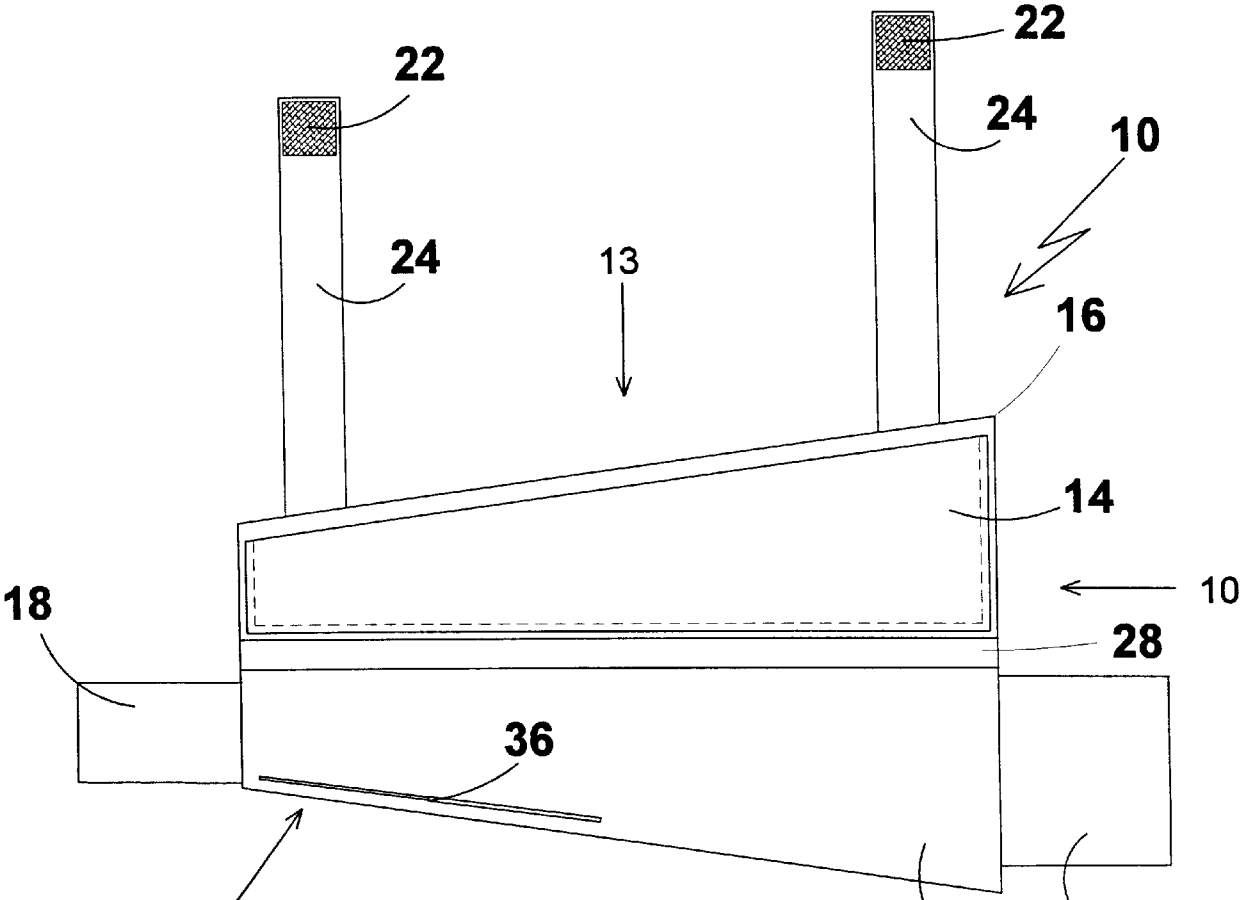
FIG. 9 is a plan view of the tool wrap as shown in FIG. 8. Shown is the tool wrap having an extendable blade guard and end flaps which fold over the tool after placement on the wrap. There is provided two long straps having hook and loop material on one end which will encircle the tool and engage mating hook and loop material on the back side of the strap.

Turning to FIG. 9, shown therein is a plan view of the present invention 10 as shown in FIG. 8. Shown is the tool wrap 28 having an extendable blade guard 36 and end flaps 18 which fold over the tool after placement in the wrap. There is provided two long straps 24 having hook and loop material 22 on one end which will encircle the tool and engage mating hook and loop material on the back side of the strap.

Figure 10:
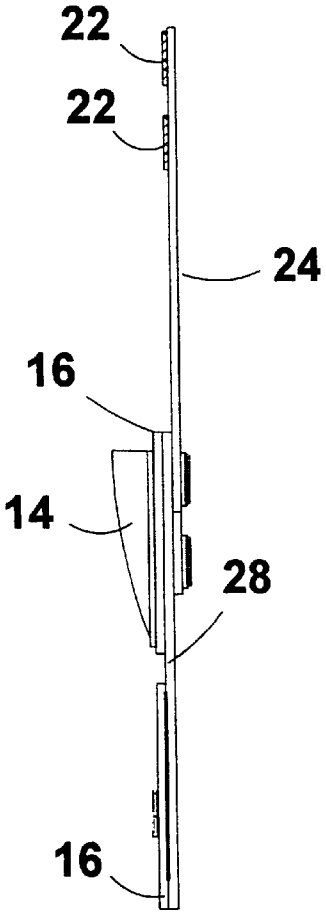
FIG. 10 is a side view of the tool wrap of the present invention, taken from FIG. 9 as indicated.

Turning to FIG. 10, shown therein is a side view of the tool wrap of the present invention, taken from FIG. 9 as indicated. Features previously disclosed are shown.

Figures 11, 12:
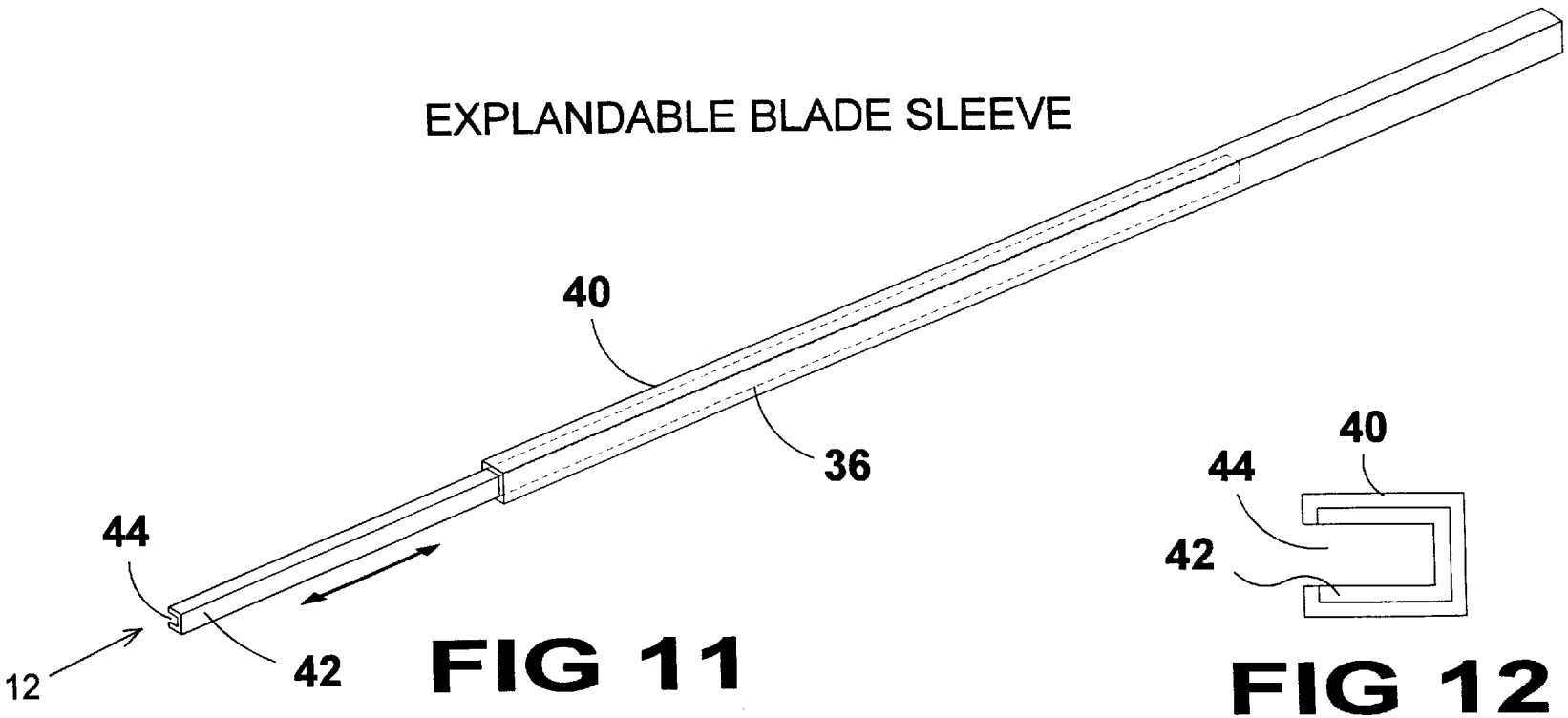
FIG. 11 is a perspective view of the extendable blade protector as shown in the tool wrap illustrated in FIG. 9.
FIG. 12 is an end view of the blade protector, taken from FIG. 11 as indicated.

Turning to FIG. 11, shown therein is a perspective view of the extendable blade protector 36 as shown in the tool wrap illustrated in FIG. 9. Shown is an outer member 40 with an inner member 42 both having a groove 44 for receiving the blade of a saw, the inner member 42 being slidable into outer member 40.

Turning to FIG. 12, shown therein is an end view of the blade protector 36, taken from FIG. 11 as indicated. Features previously disclosed are shown.

Figure 13:
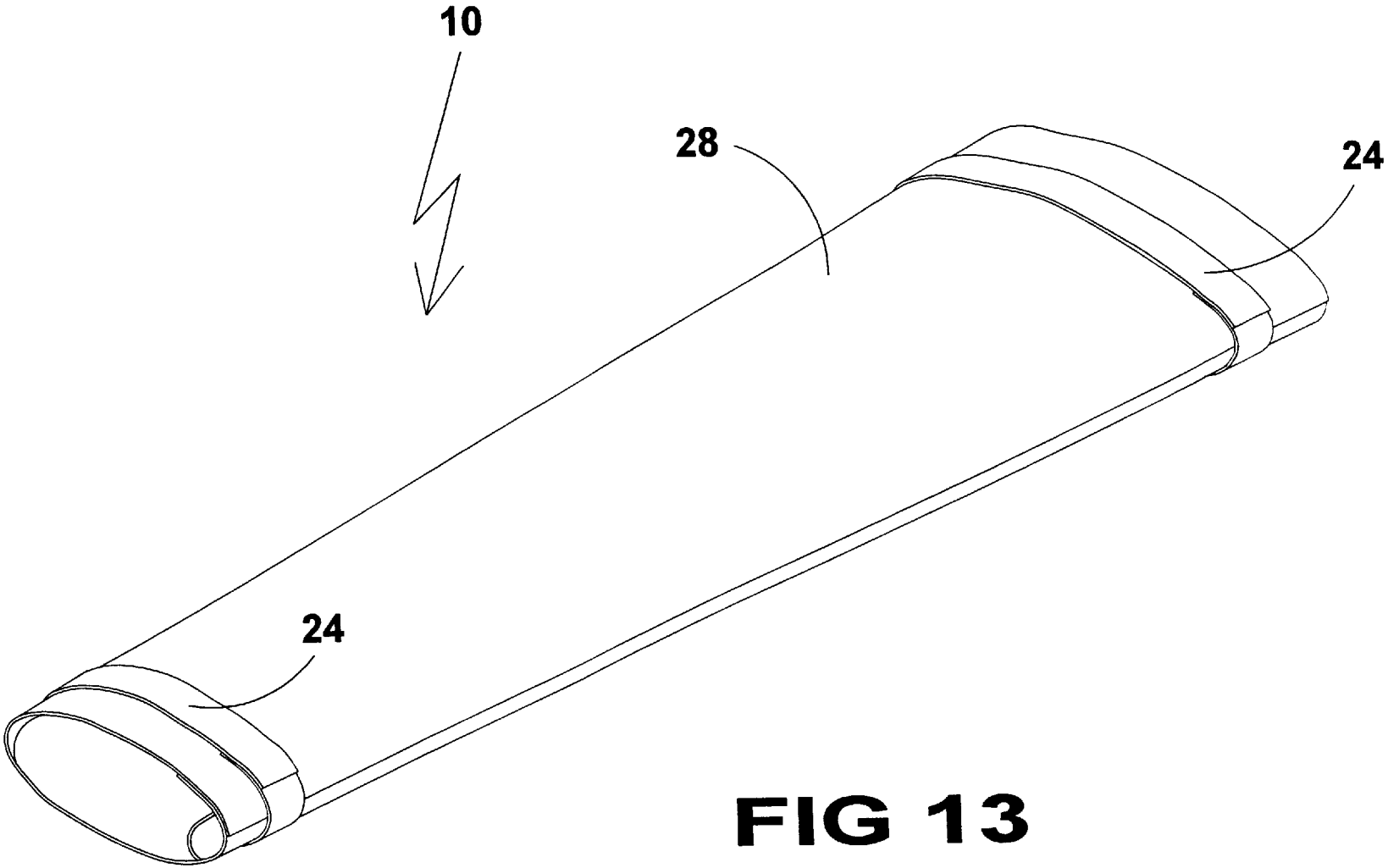
FIG. 13 is a perspective view of the wrapped tool shown in FIG. 9. Shown is a tool wrap having a selected tool therein having means for sealing the contents of the tool wrap from dust, dirt, and abrasion from other tool. In addition, the tool wrap has a handle for carrying said wrapped tool.

FIG. 13 is a perspective view of the present invention 10 shown in FIG. 9. Shown is a tool wrap 28 having a selected tool therein having means 24 for sealing the contents of the tool wrap from dust, dirt, and abrasion from other tool. In addition, the tool wrap has a handle 26 for carrying the wrapped tool.

Figure 14:
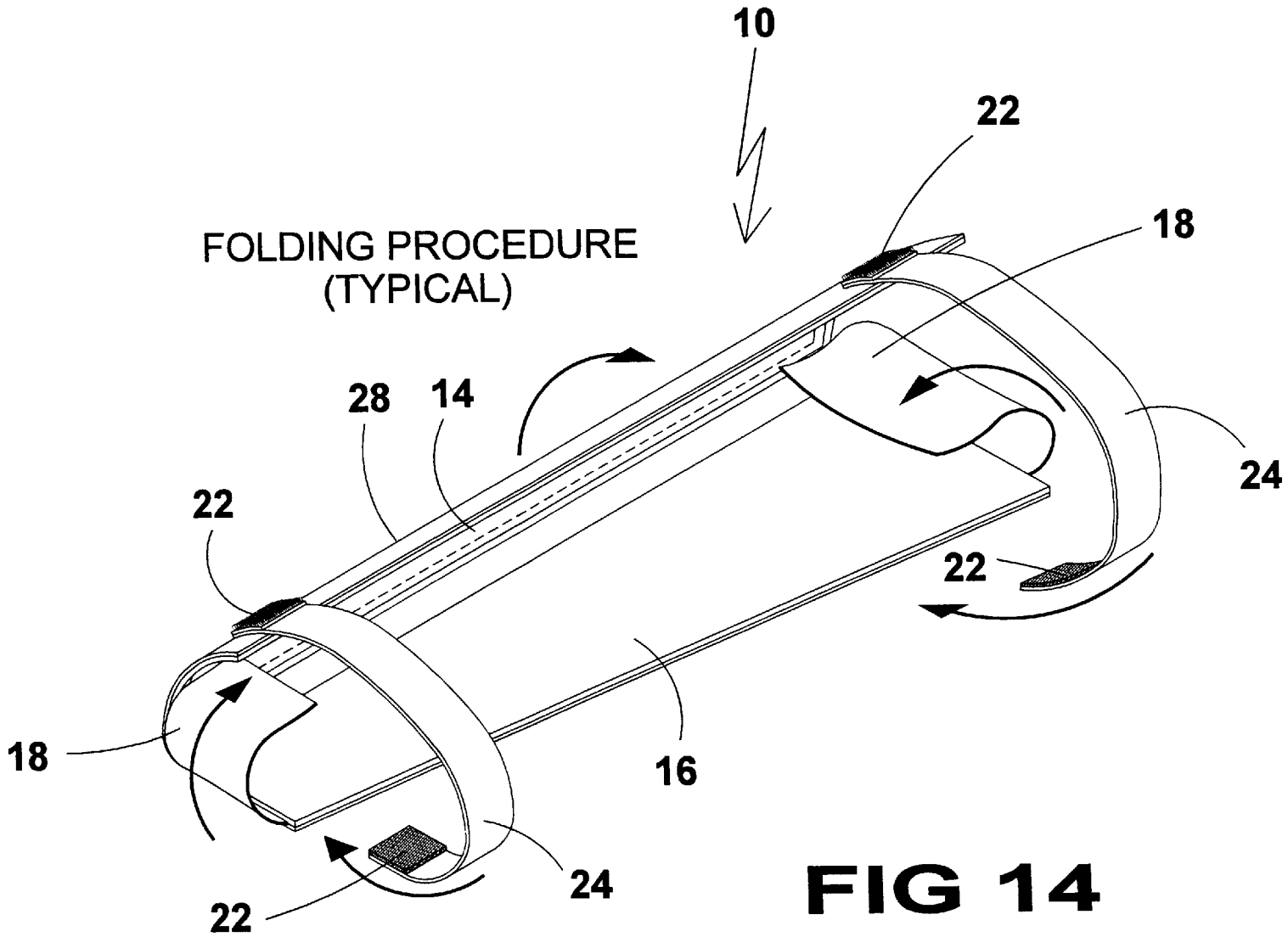
FIG. 14 is an illustrative view of the folding means for sealing said tool within said wrap.

Turning to FIG. 14, shown therein is an illustrative view of the folding procedure as previously disclosed for sealing the tool within the wrap 10.

Figure 15:
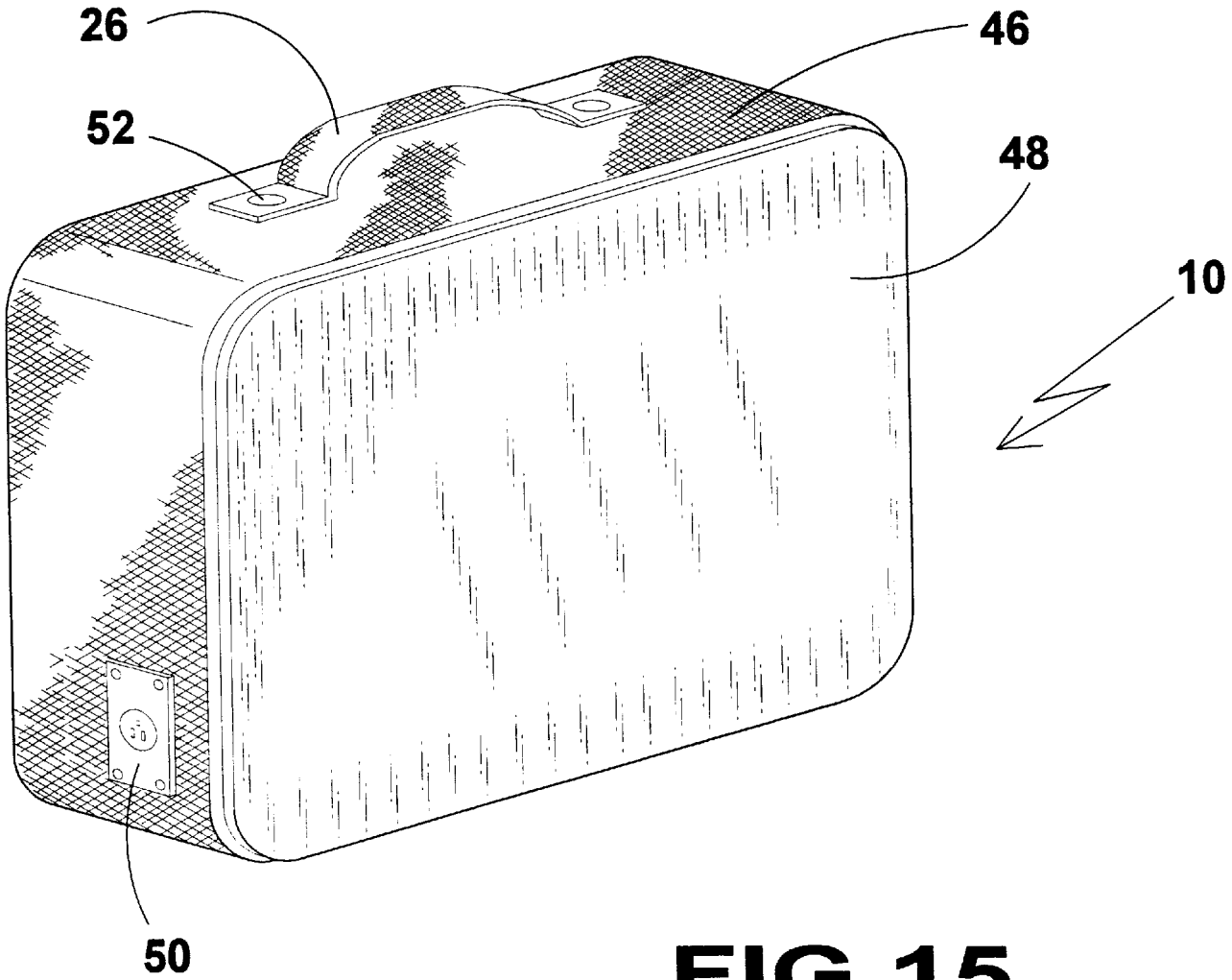
FIG. 15 is a perspective view of an alternate embodiment of the present invention. Shown is a soft tool carrying case having a detachable side panel having hook and loop material as means for attachment. Also shown is an electrical outlet box being an integral part of the carrying case. The case also has a handle.

Turning to FIG. 15, shown therein is a perspective view of an alternate embodiment of the present invention 10. Shown is a soft tool carrying case 46 having a detachable side panel 48 having hook and loop material as means for attachment. Also shown is an electrical outlet box 50 being an integral part of the carrying case 46. The case also has a handle 26 having means for attachment 52 to case 46.

Figure 16:
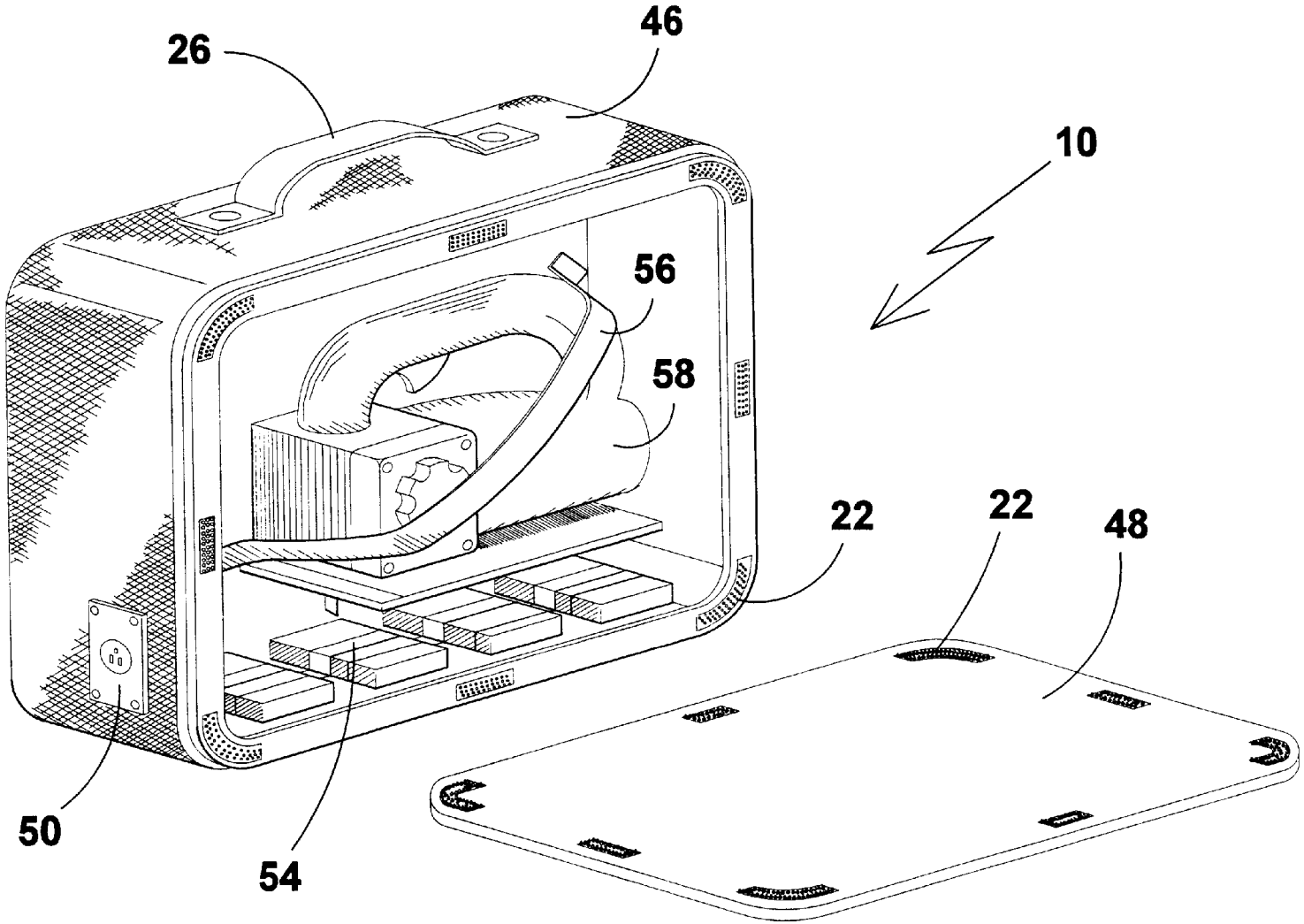
FIG. 16 is a perspective view of an alternate embodiment of the present invention having the detachable panel removed from the carrying case. Shown is a soft tool carrying case having a plurality of straps providing means for securing a plurality of items. Also shown is a large strap providing means for holding larger tool such as a jigsaw as shown. Also shown is an electrical outlet box being an integral part of the carrying case. The case also has a handle.

Turning to FIG. 16, shown therein is a perspective view of an alternate embodiment of the present invention 10 having the detachable panel 48 removed from the carrying case 46. Shown is a soft tool carrying case 10 having a plurality of straps 54 providing means for securing a plurality of items. Also shown is a large strap 56 providing means for holding larger tool such as a jigsaw 58 as shown. Also shown is an electrical outlet box 50 being an integral part of the carrying case. The case also has a handle 26 and mating hook and loop material 22 for attaching panel 48.

Figure 17:
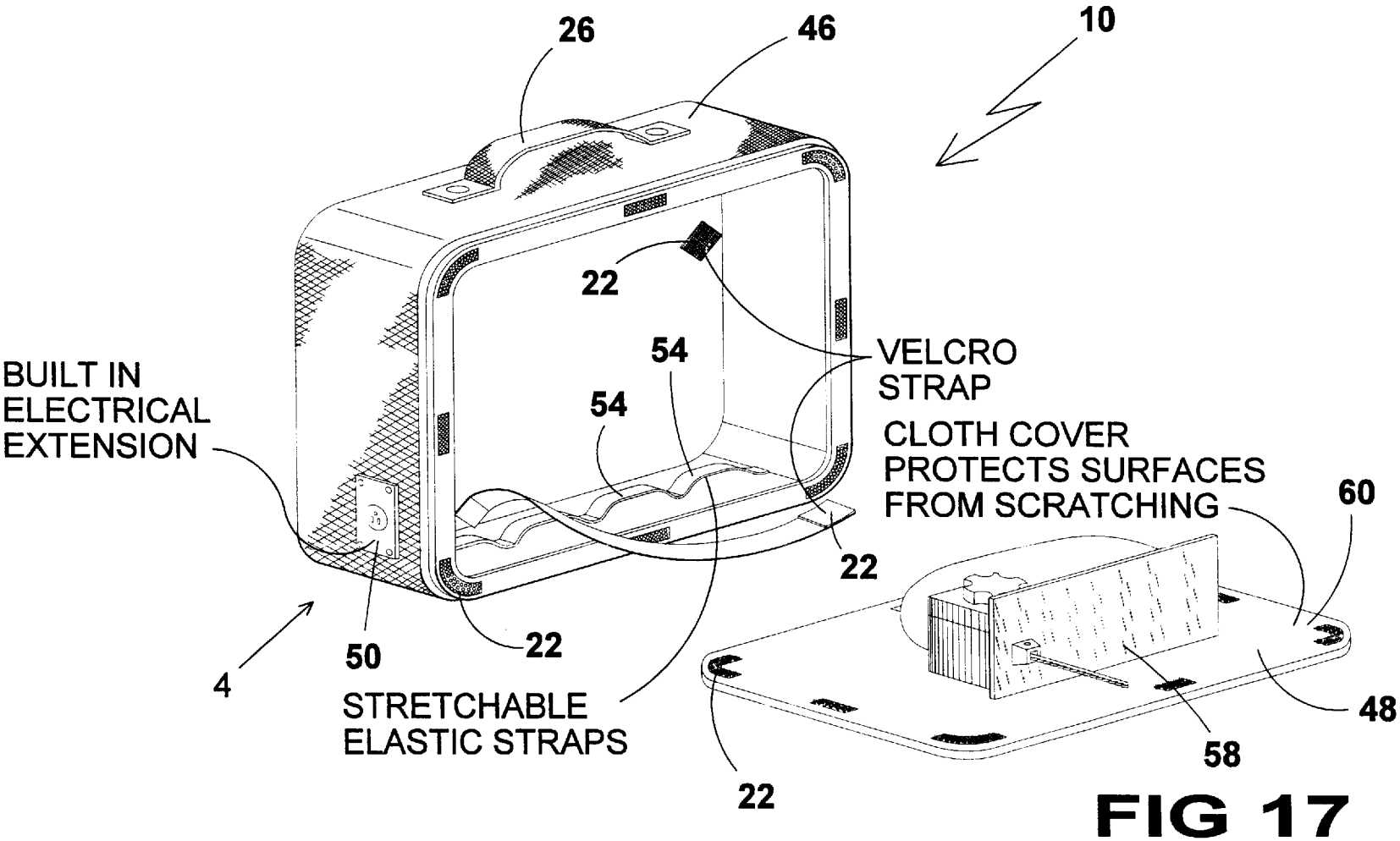
FIG. 17 is a perspective view of the alternate embodiment of the present invention. Shown is a soft tool carrying case having the detachable panel removed from the carrying case. Shown is a soft tool carrying case having a plurality of straps providing means for securing a plurality of items. Also shown is the detachable panel being used as a soft worksurface to prevent damage to tools as well as floors and furniture. Also shown is an electrical outlet box being an integral part of the carrying case. The case also has a handle.

Turning to FIG. 17, therein is shown is a perspective view of the alternate embodiment of the present invention 10. Shown is a soft tool carrying case 46 having the detachable panel 48 removed from the carrying case. Shown is a soft tool carrying case 46 having a plurality of straps 54 providing means for securing a plurality of items. Also shown is the detachable panel 48 having a cloth cover 60 being used as a soft worksurface to prevent damage to tools 58 as well as floors and furniture. Also shown is an electrical outlet box 50 being an integral part of the carrying case. The case also has a handle 26.

Figure 18:
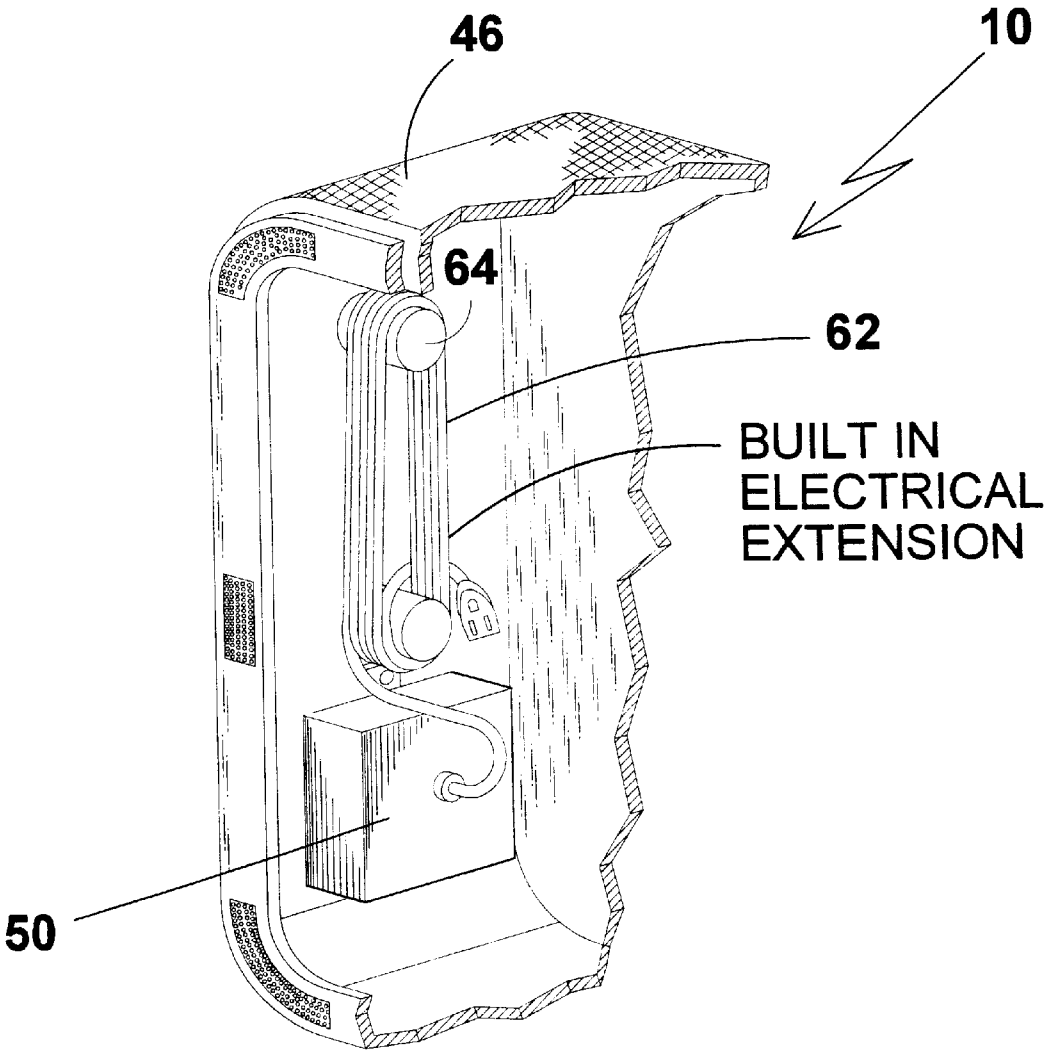
FIG. 18 is a partial view of the interior of the alternate embodiment of the present invention. Shown is the electrical outlet box being an integral part of the soft carrying case. The electrical outlet box has a long extension cord for energizing said electrical box.

Turning to FIG. 18, shown therein is a partial view of the interior of the alternate embodiment of the present invention 10. Shown is the electrical outlet box 50 being an integral part of the soft carrying case 46. The electrical outlet box 50 has a long extension cord 62 for energizing the electrical box 50 with means 64 for mounting the cord 62.

Figure 19:
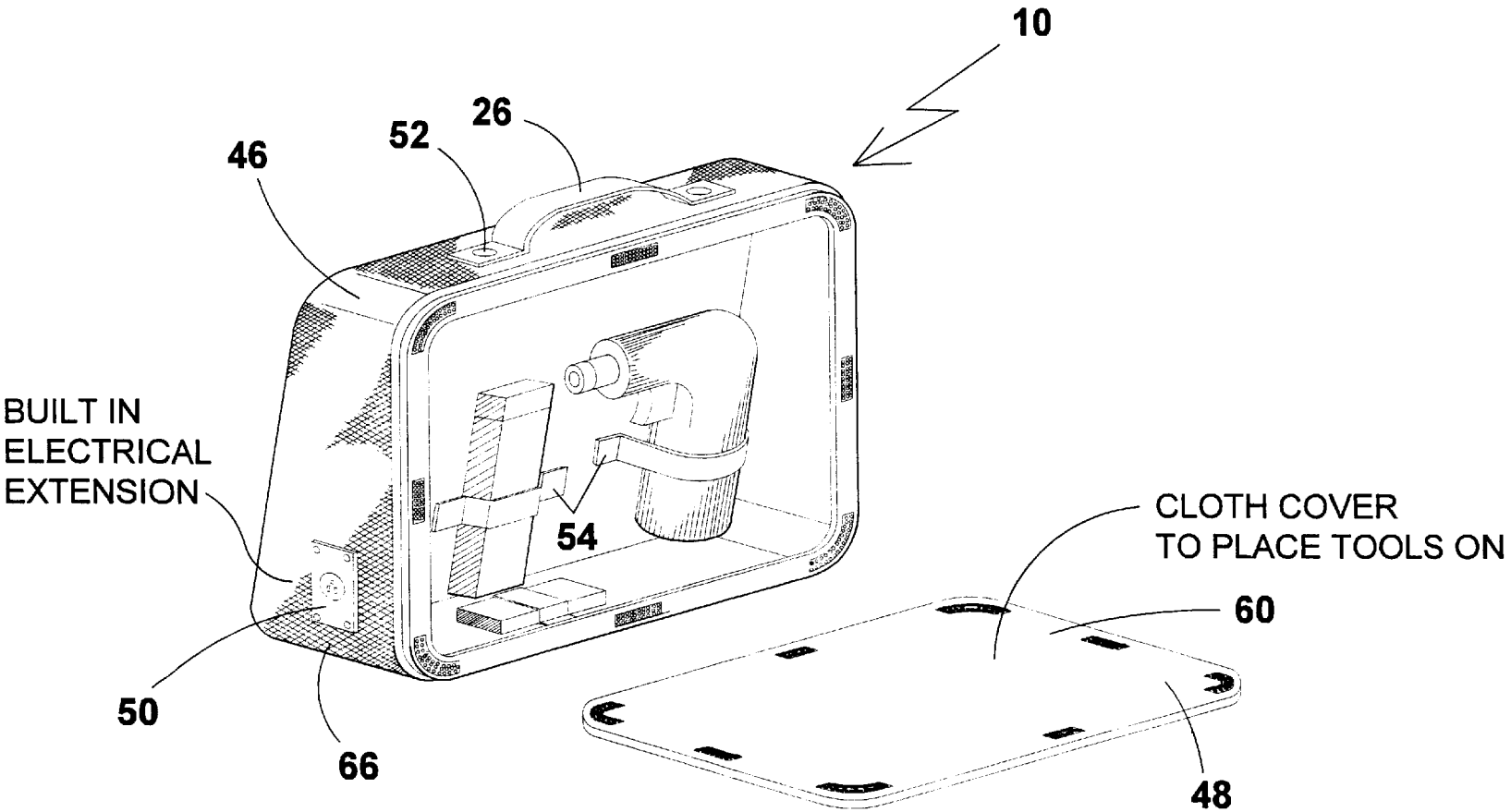
FIG. 19 is a perspective view of the alternate embodiment of the present invention having a different variation of the case. Shown is a soft tool carrying case tapering to a larger base having the detachable panel removed from the carrying case. Shown is a soft tool carrying case having a plurality of straps providing means for securing a plurality of items. Also shown is the detachable panel being used as a soft worksurface to prevent damage to tools as well as floors and furniture. Also shown is an electrical outlet box being an integral part of the carrying case. The case also has a handle.

Turning to FIG. 19, shown therein is a perspective view of the alternate embodiment of the present invention 10 having a different variation of the case. Shown is a soft tool carrying case 46 tapering to a larger base 66 having the detachable panel 48 removed from the carrying case 46. Shown is a soft tool carrying case 46 having a plurality of straps 54 providing means for securing a plurality of items. Also shown is the detachable panel 48 having a cloth cover 60 being used as a soft worksurface to prevent damage to tools as well as floors and furniture. Also shown is an electrical outlet box 50 being an integral part of the carrying case 46. The case 46 also has a handle 26 with means 52 for attachment to case 46.

Figure 20:
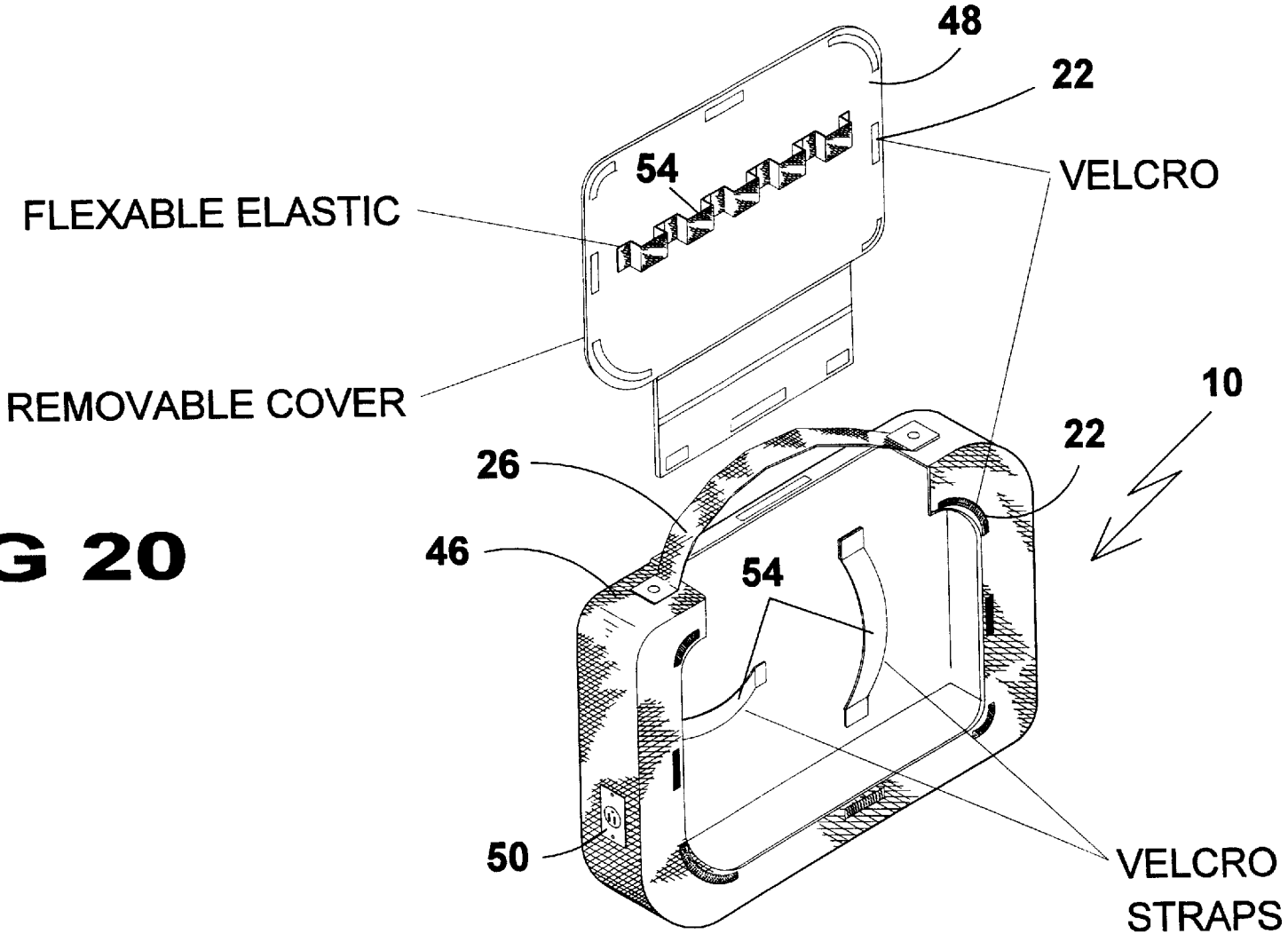
FIG. 20 is a perspective view of another variation of the alternate embodiment of the present invention. Shown is a soft tool carrying case having a plurality of straps providing means for securing a plurality of items. Also shown is the detachable panel which can be used as a soft worksurface to prevent damage to tools as well as floors and furniture. Also shown is an electrical outlet box being an integral part of the carrying case. The case also has a handle.

Turning to FIG. 20, shown therein is a perspective view of another variation of the alternate embodiment of the present invention 10. Shown is a soft tool carrying case 46 having a plurality of straps 54 providing means for securing a plurality of items. Also shown is the detachable panel 48 which can be used as a soft worksurface to prevent damage to tools as well as floors and furniture. Also shown is an electrical outlet box 50 being an integral part of the carrying case. The case also has a handle 26.

I claim:

1. A tool wrap, comprising:

a) a first and a second fabric side wall, said first fabric side wall hingedly connected to said second fabric side wall;

b) a first padding material on the interior surface of said first fabric side wall;

c) a second padding material on the interior surface of said second fabric side wall;

d) a first pocket for holding the tool accessories on the interior surface of said first padding material;

e) a second pocket for holding the tool on the interior surface of said second padding material;

f) a first cloth member on the top of said second fabric side wall and a second cloth member on the bottom of said second fabric side wall, said first and second cloth members hingedly connected to said second fabric side wall, said first and second cloth members being inwardly foldable over said second pocket;

g) a first, a second, and a third flap hingedly connected to the three-sided perimeter edge of said second fabric side wall, said first, second, and third flap each having a first means for fastening to said first fabric side wall;

h) a first and a second strap having means for connection to said exterior surfaces of said first and second fabric side wall, said first and second strap having a second means for fastening to said first and second strap whereby the tool wrap is secured; and, p1 i) a means for a handle whereby the tool wrap is carried.

2. The apparatus of claim 1, said first means for fastening further comprising mating hook and loop material.

3. The apparatus of claim 1, said second means for fastening further comprising mating hook and loop material.

4. The apparatus of claim 1, wherein said first and said second fabric side wall is rectangular shaped.

5. The apparatus of claim 1, wherein said first and said second fabric side wall is L-shaped.

6. The apparatus of claim 5, further comprising a first and a second flap hingedly connected to two-sides of the perimeter edge of said first fabric side wall, said first and second flap each having a means for fastening to said second fabric side wall.

7. The apparatus of claim 6, wherein said means for fastening further comprises mating hook and loop material.

* * * * *